US009612563B2

(12) United States Patent
Michishita et al.

(10) Patent No.: US 9,612,563 B2
(45) Date of Patent: Apr. 4, 2017

(54) IMAGE FORMING APPARATUS THAT RESTRAINS SCATTERED TONER PARTICLES

(71) Applicant: KYOCERA Document Solutions Inc., Osaka (JP)

(72) Inventors: Yasuhiro Michishita, Osaka (JP); Satoshi Uemura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/040,636

(22) Filed: Feb. 10, 2016

(65) Prior Publication Data

US 2016/0231669 A1 Aug. 11, 2016

(30) Foreign Application Priority Data

Feb. 27, 2015 (JP) ..... 2015-039144
Feb. 27, 2015 (JP) ..... 2015-039154

(51) Int. Cl.
*G03G 15/00* (2006.01)
*G03G 15/16* (2006.01)

(52) U.S. Cl.
CPC ..... *G03G 15/657* (2013.01); *G03G 15/1675* (2013.01)

(58) Field of Classification Search
CPC ..... G03G 15/1665; G03G 15/1675; G03G 15/1605
USPC ..... 399/313–317
See application file for complete search history.

(56) References Cited

U.S. PATENT DOCUMENTS

2003/0016956 A1* 1/2003 Stelter ..... G03G 15/0849 399/27
2005/0232663 A1* 10/2005 Shimura ..... G03G 15/161 399/315
2006/0013612 A1 1/2006 Shoji ..... 399/111
2010/0080615 A1* 4/2010 Kikuchi ..... G03G 21/16 399/111

FOREIGN PATENT DOCUMENTS

JP 2002-31960 A 1/2002
JP 2006-30418 A 2/2006

* cited by examiner

*Primary Examiner* — Walter L Lindsay, Jr.
*Assistant Examiner* — Jessica L Eley
(74) *Attorney, Agent, or Firm* — Stein IP, LLC

(57) ABSTRACT

An image forming apparatus includes an image carrier, a conveyance belt, a transfer roller, a suspension roller, and a conductive opposed member. The conveyance belt is in contact with the image carrier to form a nip and conveys a sheet via the nip position. A voltage of reversed polarity to a charge polarity of toner forming the toner image is applied to the transfer roller to transfer the toner image to the sheet at the nip position. A suspension roller suspends the conveyance belt at a separation position. The separation position is downstream with respect to the nip position in a sheet conveyance direction. The separation position is positioned where the sheet separates from the conveyance belt. The voltage of reversed polarity to the charge polarity of the toner is applied to the suspension roller. The conductive opposed member is arranged opposed to the suspension roller across the conveyance belt.

3 Claims, 7 Drawing Sheets

| | Applied Voltage to Downstream Roller | Shutter | | Stain of Protection Member(Printing: 30%) | |
|---|---|---|---|---|---|
| | | Material | Applied Voltage (kV) | 10 K sheets | 100 K sheets |
| Working Example 1 | Applied | SUS (Conductive) | −0.2 | Good | Good |
| Working Example 2 | Applied | SUS (Conductive) | −0.5 | Good | Good |
| Working Example 3 | Applied | SUS (Conductive) | −1.0 | Good | Good |
| Comparative Example 1 | Applied | Insulated polycarbonate | None | Good | Poor |
| Comparative Example 2 | Applied | ABS resin | None | Good | Poor |
| Comparative Example 3 | Applied | SUS (Conductive) | +1.0 | Poor | Poor |
| Comparative Example 4 | Applied | SUS (Conductive) | +0.5 | Poor | Poor |

FIG. 6

IMAGE FORMING APPARATUS THAT RESTRAINS SCATTERED TONER PARTICLES

INCORPORATION BY REFERENCE

This application is based upon, and claims the benefit of priority from, corresponding Japanese Patent Application Nos. 2015-039144 and 2015-039154, each filed in the Japan Patent Office on Feb. 27, 2015, the entire contents of which are incorporated herein by reference.

BACKGROUND

Unless otherwise indicated herein, the description in this section is not prior art to the claims in this application and is not admitted to be prior art by inclusion in this section.

An image forming apparatus that includes a conveyance belt and a transfer roller has been known. The conveyance belt is in contact with a photoreceptor drum to form a nip. The transfer roller across the conveyance belt with the photoreceptor drum and is brought into pressure contact to the photoreceptor drum. When a sheet passes through the nip position, a transfer voltage of reversed polarity to toner is applied to the transfer roller. This transfers a toner image held on the photoreceptor drum to the sheet. A suspension roller is located at a downstream with respect to the nip position in a sheet conveyance direction. The suspension roller suspends the conveyance belt at a separation position where the sheet separates from the conveyance belt.

In some cases, the image forming apparatus includes a shutter that protects the photoreceptor drum to prevent a user from damaging the surface of the photoreceptor drum during a jam process or a similar process. A shutter driving mechanism drives the shutter in conjunction with open and close operations of an open/close cover on the side surface of the image forming apparatus. The shutter driving mechanism moves the shutter to a drum protection position in association with the open operation of the open/close cover. The shutter driving mechanism moves the shutter to a drum open position in association with the close operation of the open/close cover. At the drum protection position, the shutter covers the open/close cover side of the photoreceptor drum.

SUMMARY

An image forming apparatus according to one aspect of the disclosure includes an image carrier that carries a toner image, a conveyance belt, a transfer roller, a suspension roller, and a conductive opposed member. The conveyance belt is in contact with the image carrier to form a nip. The conveyance belt conveys a sheet via the nip position. A voltage of reversed polarity to a charge polarity of toner forming the toner image is applied to the transfer roller so as to transfer the toner image to the sheet at the nip position. A suspension roller suspends the conveyance belt at a separation position. The separation position is downstream with respect to the nip position in a sheet conveyance direction. The separation position is positioned where the sheet separates from the conveyance belt. The voltage of reversed polarity to the charge polarity of the toner is applied to the suspension roller. The conductive opposed member is arranged opposed to the suspension roller across the conveyance belt.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

BRIEF DESCRIPTION OF THE DRAWINGS

FIG. 6 illustrates a result of a continuous printing test when applied voltages to a shutter according to one embodiment are variously changed.

DETAILED DESCRIPTION

Figure 1:
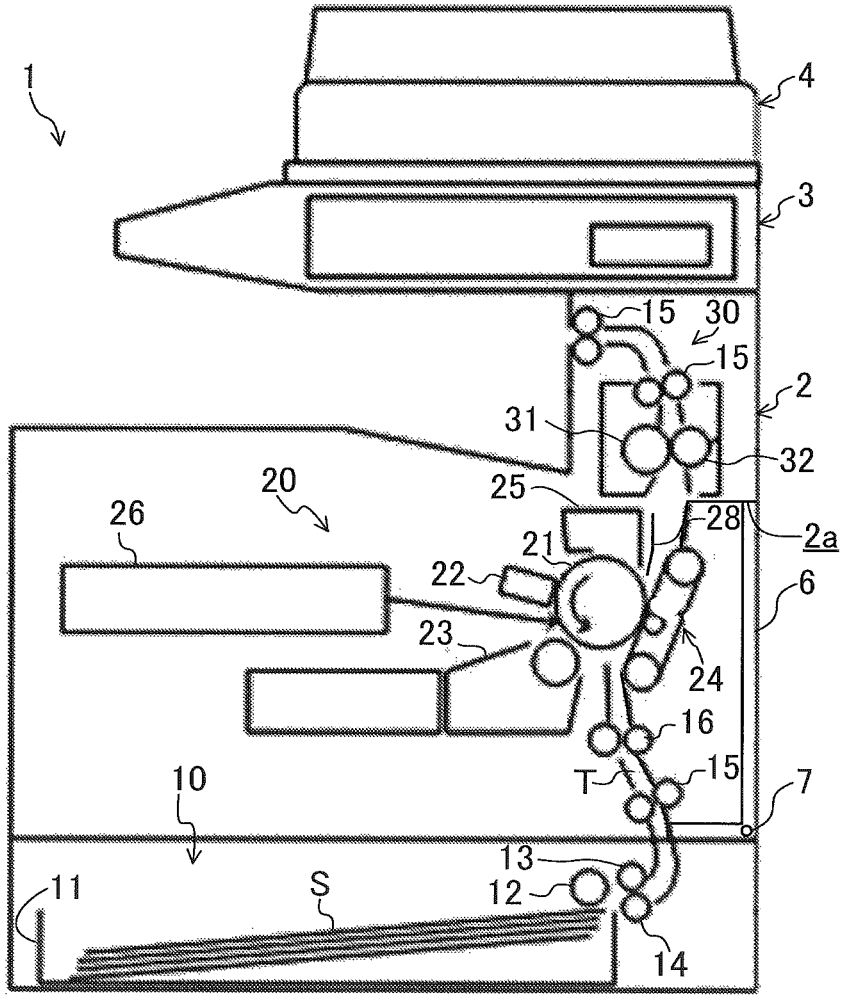
FIG. 1 schematically illustrates an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Hereafter, a description will be given of embodiments of the disclosure with reference to the drawings in detail. The disclosure will not be limited to the embodiments described below.

Embodiments

FIG. 1 illustrates a monochrome copier, which is an example of an image forming apparatus, according to this embodiment. An image forming apparatus 1 includes a housing 2, an image reading unit 3, and an Automatic Document Feeder (ADF) 4. The image reading unit 3 is mounted on the upper end portion of the housing 2. The ADF 4 is located so as to cover a document loading surface of the image reading unit 3. The image reading unit 3 includes a light source, a reflection mirror, a Charge Coupled Device (CCD), or a similar unit and optically reads images on a document set to the document loading surface or images on a document supplied from the ADF 4. The image reading unit 3 converts the read document images into data and transmits the document images to an image forming unit 20, which will be described later.

The housing 2 internally houses a paper sheet feeder 10, the image forming unit 20, and a fixing unit 30. The paper sheet feeder 10 is located at the bottom portion of the housing 2. The paper sheet feeder 10 includes a sheet feed cassette 11, a pick roller 12, a feed roller 13, and a retard roller 14. The sheet feed cassette 11 houses a plurality of sheets S stacked to one another. The pick roller 12 picks up the sheets S in the sheet feed cassette 11 one by one. The feed roller 13 and the retard roller separate the picked-up sheet S one by one and sends out the sheet S to a conveyance path T.

The image forming unit 20 is located above the paper sheet feeder 10 in the housing 2. The image forming unit 20 includes a photoreceptor drum 21, a charger 22, a developing device 23, a transfer apparatus 24, a cleaning unit 25, and a light scanning device 26. The photoreceptor drum 21 is an image carrier rotatably located inside the housing 2. The light scanning device 26 is located on the upper side of the photoreceptor drum 21.

The fixing unit 30 is located above the image forming unit 20. The fixing unit 30 includes a fixing roller 31 and a pressure roller 32. The fixing roller 31 is heated by a heating unit such as a heater. The pressure roller 32 is brought into pressure contact by the fixing roller 31.

When the image forming unit 20 receives image data from the image reading unit 3, a motor (not illustrated) rotatably drives the photoreceptor drum 21 and the charger 22 charges the surface of the photoreceptor drum 21 at a predetermined electric potential. In this embodiment, the charger 22 charges the surface of the photoreceptor drum 21 to positive polarity. After the surface of the photoreceptor drum 21 is charged, based on the image data from the image reading unit 3, the light scanning device 26 emits laser light to the photoreceptor drum 21. The irradiation of laser light on the surface of the photoreceptor drum 21 forms an electrostatic latent image. The electrostatic latent image formed on the photoreceptor drum 21 is developed with toner charged by the developing device 23 to be visualized as a toner image. This embodiment forms the toner image by a so-called reversal development. A charge polarity of the toner charged by the developing device 23 becomes positive polarity (polarity identical to the charge polarity on the surface of the photoreceptor drum 21). The toner image may be formed not only by the reversal development but by normal development. In this case, the charge polarity of the toner becomes a negative polarity.

After the toner image is formed on the surface of the photoreceptor drum 21, the sheet S delivered from a registration roller pair 16 is pressed against the surface of the photoreceptor drum 21 by the transfer apparatus 24. Then, the transfer apparatus 24 applies the transfer voltage at a charge polarity opposite to the charge polarity (the negative polarity in this embodiment) of the toner to this sheet S. This transfers the toner image of the photoreceptor drum 21 to the sheet S. The fixing roller 31 and the pressure roller 32 heat and apply pressure to the sheet S to which the toner image has been transferred at the fixing unit 30. This fixes the toner image on the sheet S.

Figure 2:
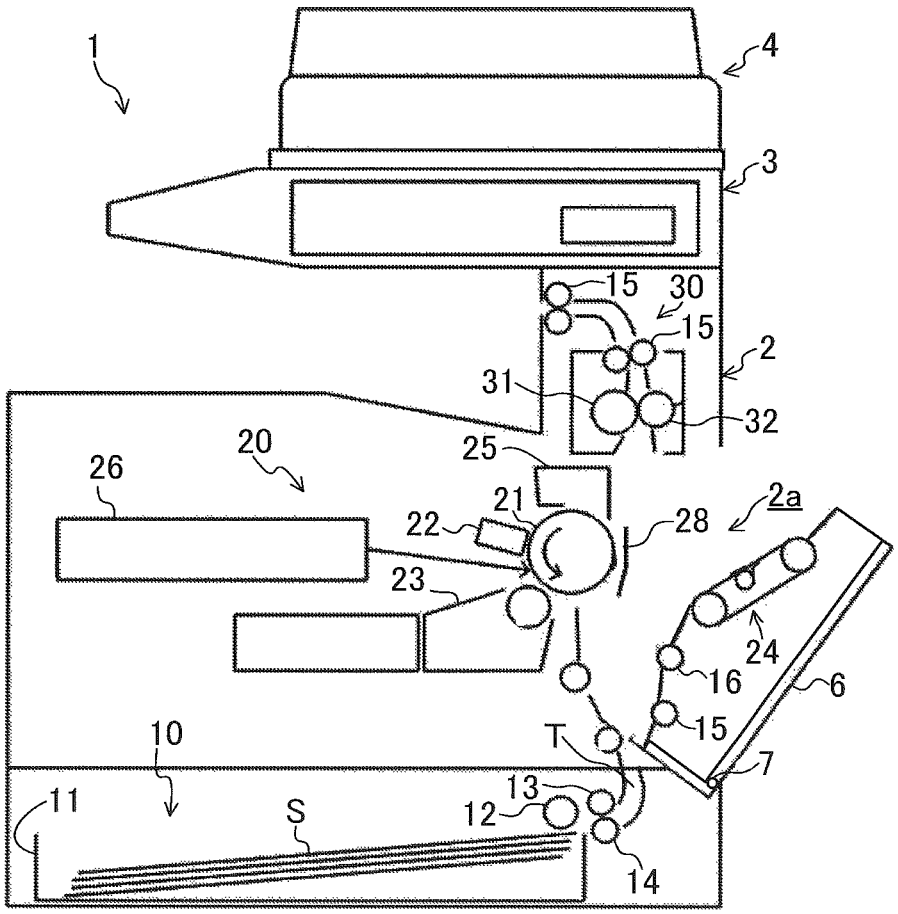
FIG. 2 schematically illustrates an open state of an open/close cover of the image forming apparatus according to one embodiment.

An opening 2*a* is formed at a part positioned on the right side of the transfer apparatus 24 in the housing 2. The opening 2*a* is obstructed so as to be openable/closable with an open/close cover 6. The open/close cover 6 and the transfer apparatus 24 are formed into a unit. The open/close cover 6 is turnable with a shaft portion 7 as a fulcrum. The shaft portion 7 extends in the front-rear direction along the lower end edge of the opening 2*a*. FIG. 1 illustrates the obstructed state of the opening 2*a* by the open/close cover 6. When turning the open/close cover 6 from this state to the right side with the shaft portion 7 as the fulcrum, the opening 2*a* opens as illustrated in FIG. 2. The operator can perform a jam process of the sheet S or a similar process through this opening 2*a*.

A shutter 28 as an image carrier protection member is located on obliquely right upward of the photoreceptor drum 21 in FIG. 1. The shutter 28 has a function of protecting the photoreceptor drum 21 to prevent the user from damaging the surface of the photoreceptor drum 21 when the user opens the open/close cover 6. The shutter 28 is, for example, made of a conductive member such as SUS. The conductive member includes, for example, stainless steel (SUS), conductive polyethylene (PE), or conductive polyacetal (POM). A shutter driving mechanism 27 (see FIG. 3) drives the shutter 28 in conjunction with open and close operations of the open/close cover 6. The shutter driving mechanism 27 moves the shutter 28 to a drum protection position in association with the open operation of the open/close cover 6. Meanwhile, the shutter driving mechanism 27 moves the shutter 28 to a drum open position in association with the close operation of the open/close cover 6. At the drum protection position, the shutter 28 covers the open/close cover 6 side of the photoreceptor drum 21 (see FIG. 2). At the drum open position, the shutter 28 retracts upward with respect to the drum protection position to open the open/close cover 6 side of the photoreceptor drum 21 (see FIG. 1). The shutter 28 functions as a conductive opposed member, which is opposed to a downstream roller 244 across a conveyance belt 241 at the drum open position. A separation distance between this shutter 28 and the downstream roller 244 is 8 mm in this embodiment. The separation distance is, for example, preferably within the range of 5 mm or more to 10 mm or less. The shutter 28 is grounded via ground wiring G1. The shutter driving mechanism 27, for example, may have a mechanism of a mechanical drive system using a cam or a similar component. The shutter driving mechanism 27 may have a mechanism of an electrical drive system, which detects the open and close operations of the open/close cover 6 by a sensor and drives the shutter 28 based on the detection result by a motor.

Figure 3:
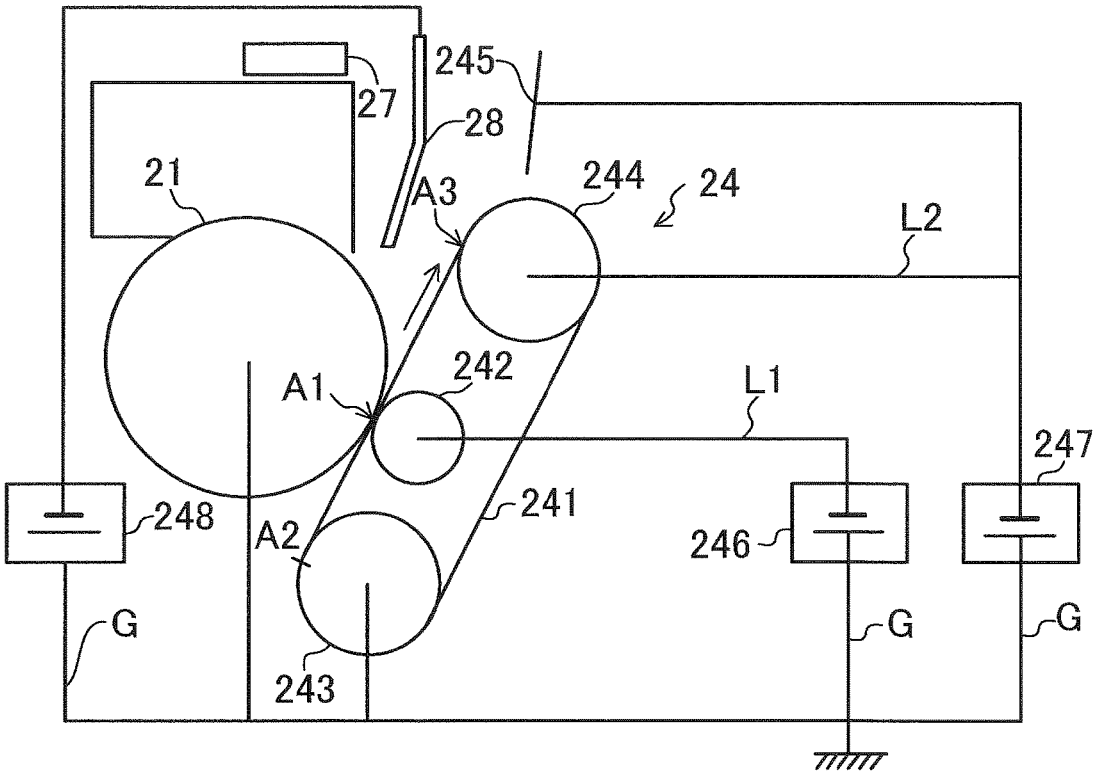
FIG. 3 schematically illustrates a configuration of a transfer apparatus according to one embodiment.
Figure 4:
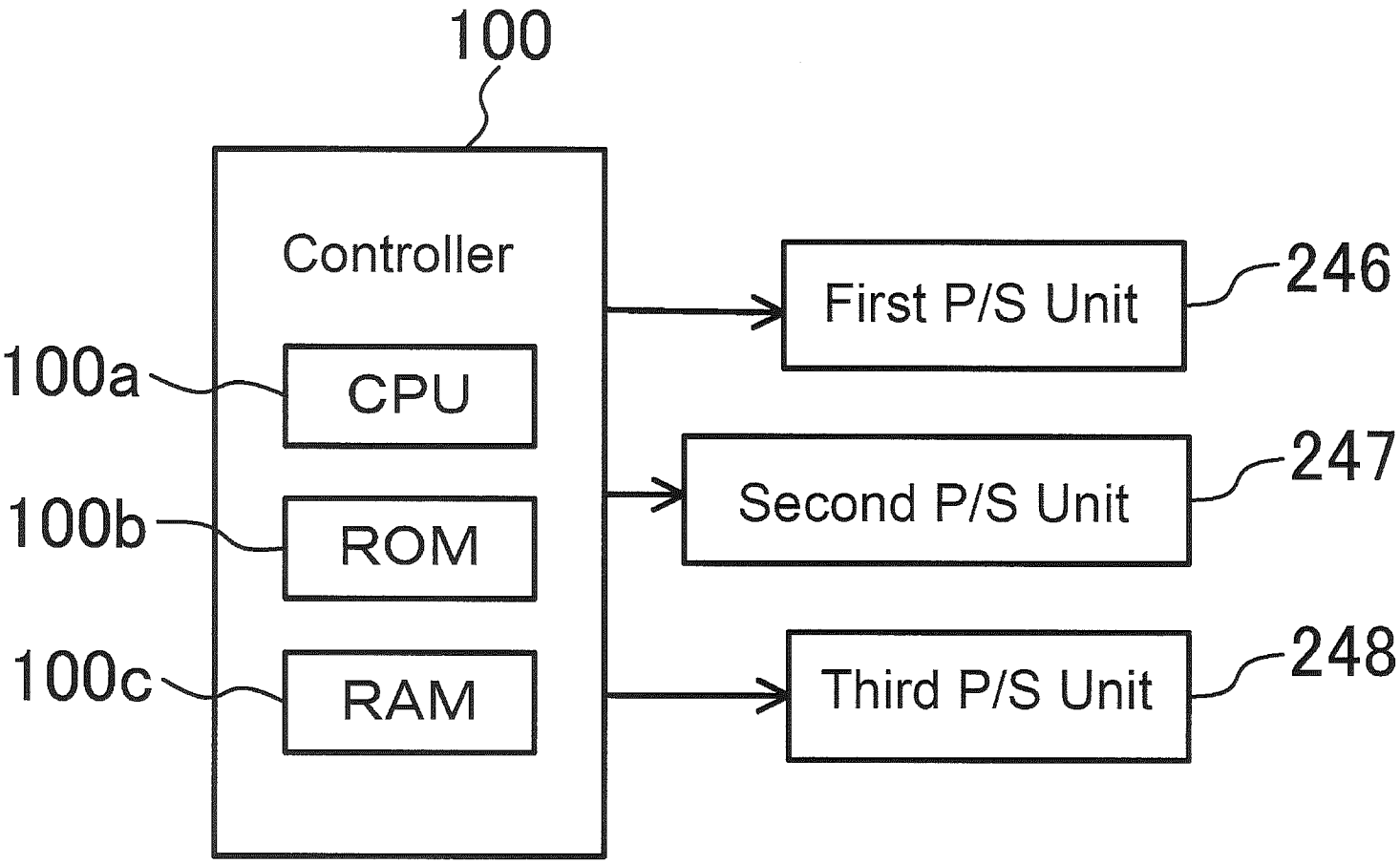
FIG. 4 illustrates a configuration of a control system that controls a first power supply unit to a third power supply unit connected to the transfer apparatus according to one embodiment.

As illustrated in FIG. 3, the transfer apparatus 24 includes an endless conveyance belt 241, a transfer roller 242, an upstream roller 243, the downstream roller 244, a first power supply unit 246, a second power supply unit 247 (also referred to as a suspension roller power supply unit (circuit)), and a third power supply unit 248.

The conveyance belt 241 causes the sheet S to electrostatically adhere to the outer peripheral surface of the conveyance belt 241 while conveying the sheet S. The outer peripheral surface of the conveyance belt 241 is in contact with the photoreceptor drum 21 to form a nip with this photoreceptor drum 21. The conveyance belt 241 is suspended by the upstream roller 243 and the downstream roller 244 at a predetermined tensile strength. The motor (not illustrated) rotatably drives the upstream roller 243 or the downstream roller 244 to drive the conveyance belt 241 in the direction indicated by the arrow B in FIG. 3. The conveyance belt 241 is formed by coating the outer peripheral surface of a belt-shaped member made of, for example, rubber with fluorine-based resin.

The transfer roller 242 is arranged opposed to the photoreceptor drum 21. The outer peripheral surface of the transfer roller 242 is in contact with the inner circumference surface of the conveyance belt 241. The transfer roller 242 is brought into pressure contact with the photoreceptor drum 21 across the conveyance belt 241 at a predetermined load. Accordingly, the conveyance belt 241 and the photoreceptor drum 21 nip the sheet S at a nip position A1. Then, the transfer roller 242 applies a transfer voltage C1, which has the reversed polarity to the charge polarity of the toner, to the sheet S passing through the nip position A1 to transfer the toner image to the sheet S.

The upstream roller 243 suspends the conveyance belt 241 at a conveyance start position A2. The conveyance start position A2 is upstream with respect to the nip position A1 in the sheet conveyance direction and is positioned where the front end of the sheet S approaches the conveyance belt 241. The upstream roller 243 is made of a conductive member such as metal. The upstream roller 243 is grounded via a bearing, ground wiring G2, or a similar member. In this embodiment, a front end and a rear end of the sheet S mean the front end and the rear end of the sheet in the sheet conveyance direction, respectively.

The downstream roller (the suspension roller) 244 suspends the conveyance belt 241 at a separation position A3. The separation position A3 is downstream with respect to the nip position A1 in the sheet conveyance direction and is positioned where the rear end of the sheet S separates from the conveyance belt 241. The downstream roller 244 is made of a conductive member such as metal.

A guiding member 245 is located downstream with respect to the downstream roller 244 in the sheet conveyance direction. The guiding member 245 guides the sheet S away of the conveyance belt 241 at the separation position A3 to the fixing unit 30. The guiding member 245 is made of a conductive member such as metal. In this embodiment, the guiding member 245 is grounded via ground wiring G3.

The first power supply unit 246 selectively switches a voltage between the transfer voltage C1 and a standby voltage C2 to apply the voltage to the transfer roller 242. The negative electrode side terminal of the first power supply unit 246 is connected to the transfer roller 242 via wiring L1. The positive electrode side terminal of the first power supply unit 246 is grounded via ground wiring G (G4).

The transfer voltage C1 is a voltage of reversed polarity to the charge polarity of the toner. The transfer voltage C1 is a voltage to transfer the toner image on the photoreceptor drum 21 to the sheet S. The standby voltage C2 is a voltage of identical polarity to the charge polarity of the toner and to prevent the toner from attaching to the transfer roller 242 while an image is not formed. A controller 100 (also referred as a control unit (circuit)) controls the magnitude and application timing of the transfer voltage C1 and the standby voltage C2.

The second power supply unit 247 applies a toner-particle-scattering restraining voltage C3 to the downstream roller 244. The negative electrode side terminal of the second power supply unit 247 is connected to the downstream roller 244 via wiring L2. The positive electrode side terminal of the second power supply unit 247 is grounded via ground wiring G (G5).

The toner-particle-scattering restraining voltage C3 is a voltage of reversed polarity to the charge polarity of the toner. The toner-particle-scattering restraining voltage C3 prevents electric charges of reversed polarity to the charge polarity of the toner from flowing out from the sheet S. This restrains separating discharge when the sheet S separates at the separation position A3. Additionally, this restrains the scatter of toner particles.

The third power supply unit 248 (also referred to as a protection member power supply unit (circuit)) applies a shutter voltage C4 to the shutter 28. The negative electrode side terminal of the third power supply unit 248 is connected to the shutter 28. The positive electrode side terminal of the third power supply unit 248 is grounded via the ground wiring G.

The shutter voltage C4 is a voltage of reversed polarity to the charge polarity of the toner. The shutter voltage C4 restrains scattering of reversely charged toner particles (toner particles of negative polarity in this embodiment), which are infinitesimally contained in the toner image carried by the sheet S, and adhesion of the reversely charged toner particles to the shutter 28.

Figure 5:
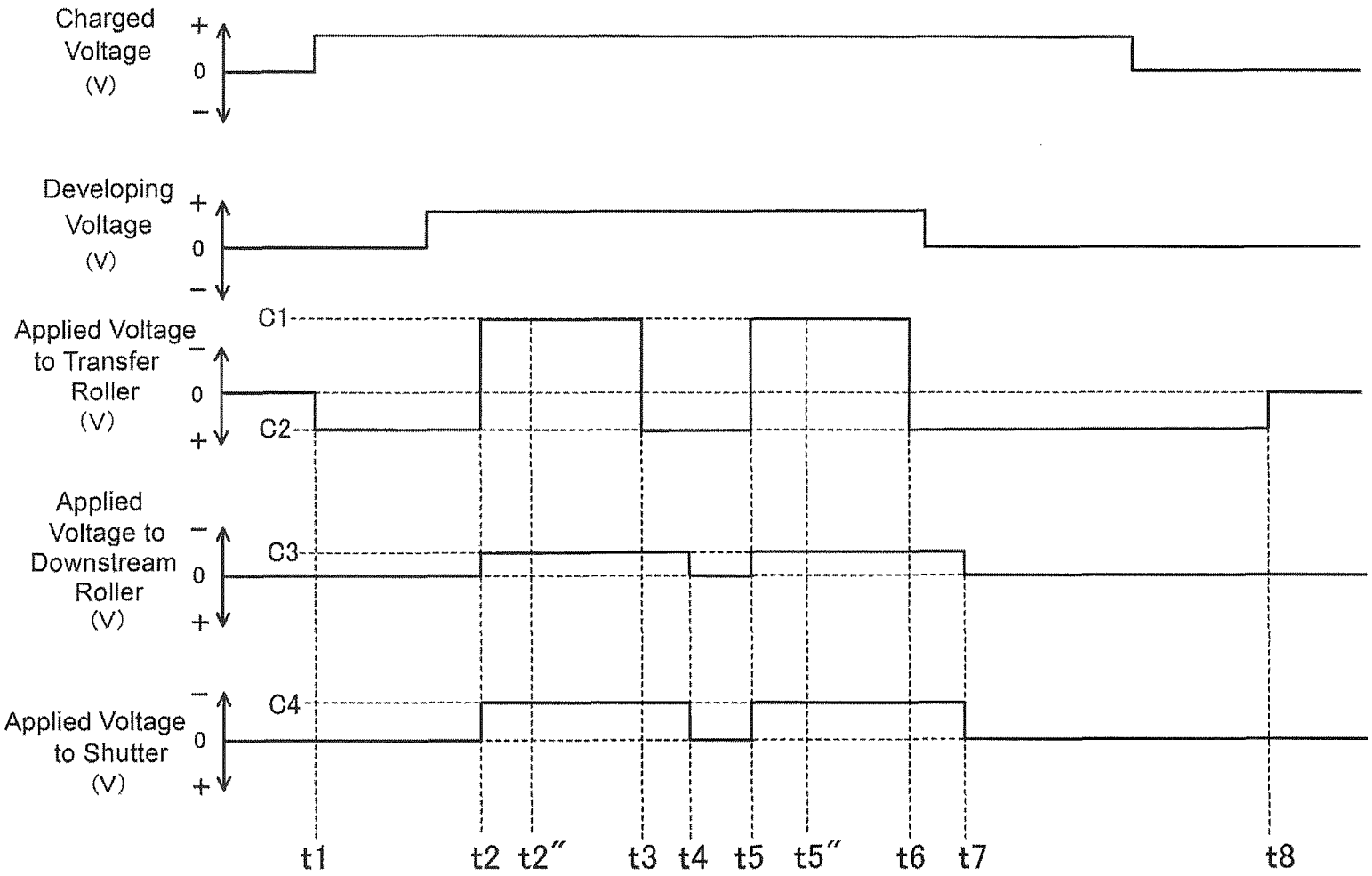
FIG. 5 illustrates an example of a voltage application control by a controller according to one embodiment.
Figure 7:
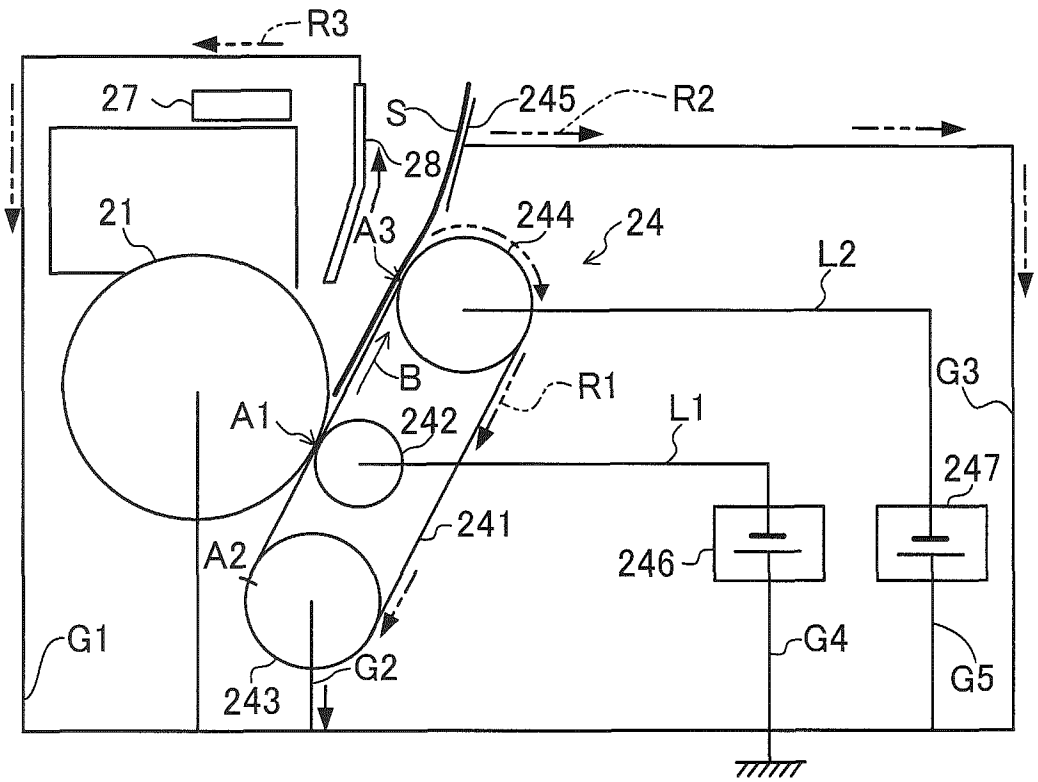
FIG. 7 schematically illustrates a configuration of a transfer apparatus according to another embodiment.

FIG. 5 illustrates an example of a voltage application control performed by the controller 100. This timing chart illustrates an example of performing continuous printing on the two sheets S. When the image forming apparatus 1 accepts a print start request, a printing operation starts and a charged voltage is applied to the photoreceptor drum 21. After that, a developing voltage is applied to the developing device 23. At time t1, simultaneous with the start of printing operation by the image forming apparatus 1, the standby voltage C2, which is identical polarity (the positive polarity in this embodiment) to the charge polarity of the toner, is applied to the transfer roller 242. At time t2, simultaneous with the front end of the sheet S reaching the nip position A1, the transfer voltage C1, which is the reversed polarity (the negative polarity in this embodiment) to the charge polarity of the toner, is applied to the transfer roller 242. Additionally, to the downstream roller 244, the toner-particle-scattering restraining voltage C3, which is the reversed polarity (the negative polarity in this embodiment) to the charge polarity of the toner, is applied. Additionally, to the shutter 28, the shutter voltage C4, which is the reversed polarity to the charge polarity of the toner, is applied. At time t2", the front end of the sheet S reaches the separation position A3. At this time point, the toner-particle-scattering restraining voltage C3 and the shutter voltage C4 have already been applied to the downstream roller 244. At time t3, simultaneous with the rear end of the sheet S passing through the nip position A1, the applied voltage to the transfer roller 242 switches from the transfer voltage C1 to the standby voltage C2. At time t4, when the rear end of the sheet S passes through the separation position A3, the application of the toner-particle-scattering restraining voltage C3 to the downstream roller 244 is stopped and also the application of the shutter voltage C4 to the shutter 28 is stopped. At times t5 to t7, when printing the subsequent sheets S, processes identical to the times t2 to t4 are performed. At time t8, the application of the voltage to the transfer roller 242 is stopped, thus terminating the printing operation.

With the image forming apparatus 1, from when at least the front end of the sheet S reaches the separation position A3 (the time t2") until the rear end of the sheet S passes through the separation position A3 (the time t4), the toner-particle-scattering restraining voltage C3 of the reversed polarity to the charge polarity of the toner is applied to the downstream roller 244. When the rear end of the sheet S separates from the conveyance belt 241 at the separation position A3, this ensures preventing the electric charges of reversed polarity to the charge polarity of the toner from flowing out from the rear end of the sheet S to the downstream roller 244 and discharging. This ensures holding the electric charges of reversed polarity to the toner polarity on the sheet S, causing the sheet S to reliably adsorb the toner image.

However, if a voltage (the toner-particle-scattering restraining voltage C3) of reversed polarity to the charge polarity of the toner is applied to the downstream roller 244 as described above, the applied voltage to the downstream roller 244 repels the reversely charged toner (toner of reversed polarity to the charge polarity to be given to the toner by the developing device 23) infinitesimally contained in the toner image from the sheet S, resulting in scattering.

Since this amount of scattered reversely charged toner particles is a trace, an influence to contamination inside the device is small. However, the adhesion of the reversely charged toner to the surface of the shutter 28, which protects the photoreceptor drum 21, possibly stains the operator's hands with the toner adhered to the surface of the shutter 28 when the operator performs the jam process or a similar process.

On the other hand, this embodiment applies the shutter voltage C4, which is the reversed polarity (the identical polarity to the reversely charged toner) to the charge polarity of the toner to the shutter 28 by the third power supply unit 248. This ensures preventing the reversely charged toner from adhering to the shutter 28.

In this embodiment, a period during which the toner-particle-scattering restraining voltage C3 is applied to the downstream roller 244 and a period during which the shutter voltage C4 is applied to the shutter 28 are same. This applies the shutter voltage C4 to the shutter 28 only when the reversely charged toner particles are more likely to scatter. Accordingly, compared with the case where the shutter voltage C4 is kept applying across the entire period, from the start of printing operation until the end of the printing operation, this ensures improving energy saving performance.

The timing chart illustrated in FIG. 5 is merely an example. For example, the timing of applying the toner-particle-scattering restraining voltage C3 and the shutter voltage C4 may be the time t2", which is later than the time t2.

Working Example

FIG. 6 illustrates results of the continuous printing test with the image forming apparatus 1 when using the configuration of the embodiment. A charge polarity given from the developing device 23 to toner is a positive polarity. The magnitude of the charge polarity is +30 to +40 μC/g. In Working Example 1 to Working Example 3, the shutters 28 were made of SUS, which was a conductive metal. The shutter voltage C4 of negative polarity was applied to the shutters 28. In Comparative Example 1 and Comparative Example 2, the shutters 28 were made of polycarbonate and an ABS resin, which were insulating members. The voltage was not applied to the shutters 28. Similar to Working Example 1 and Working Example 2, in Comparative Example 3 and Comparative Example 4, the shutters 28 were made of SUS, which was the conductive metal. The voltage of positive polarity was applied to the shutters 28. Then, the continuous printing was performed with the setting of printing rate of the sheet S to 30%. The presence/absence of stain in the respective shutters 28 was checked at the ending time point of printing of 10 K (K=1000) sheets and at the ending time point of printing of 100 K sheets. "Good" in the table means absence of stain. "Poor" in the table means presence of stain.

It was found that when applying the shutter voltage C4 of negative polarity (the reversed polarity to the charge polarity of the toner) to the shutters 28 (the cases of Working Example 1 to Working Example 3), at the ending time point of printing of 100 K sheets, the toner does not adhere to the shutters 28. Meanwhile, when applying the voltage of positive polarity to the shutters 28 or not applying the voltage, at the ending time point of printing of 100 K sheets, the toner adheres to the shutters 28.

In this embodiment, the opposed member (the shutter 28), which is made of conductive member, is located at the position opposed to the conveyance belt 241 toward the downstream roller 244. This ensures further reliably supplying the electric charges of reversed polarity to the charge polarity of the toner from the downstream roller 244 to the sheet S. That is, assume the case where the shutter 28, which is the opposed member, is made of the insulating member. Flow passages for electric charges supplied from the downstream roller 244 to the sheet S are only two routes: a route R1 (conveyance belt 241→upstream roller 243→ground wiring G2→ground) and a route R2 (guiding member 245→ground wiring G3→ground). However, when the shutter 28 is made of the conductive member, the electric charges on the sheet S also attempts to pass through a route R3 (shutter 28→ground wiring G1→ground). Accordingly, compared with the case where the flow passages for electric charges are only two systems: the route R1 and the route R2, electric charges are smoothly supplied from the downstream roller 244 to the sheet S (the electric charges of reversed polarity to the charge polarity of the toner). This ensures further reliably preventing separating discharge of the sheet S.

This embodiment uses the shutter 28, which is the existing component, as the opposed member opposed to the downstream roller 244. This ensures reducing a product cost.

Other Embodiments

The embodiment gives the description with the copier as one example of the image forming apparatus 1. This, however, should not be construed in a limiting sense. The image forming apparatus 1 may be a printer, a multi-functional peripheral (MFP), or a similar device.

The embodiment describes the example of the charge polarity of toner, which is the developer, being a positive polarity. This, however, should not be construed in a limiting sense. The disclosure is also applicable to the case where the charge polarity of toner is a negative polarity.

As described above, the disclosure is effective to the image forming apparatus.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus, comprising:

an image carrier that carries a toner image;

a conveyance belt in contact with the image carrier to form a nip, the conveyance belt conveying a sheet via the nip position;

a transfer roller to which a voltage of reversed polarity to a charge polarity of toner forming the toner image is applied, so as to transfer the toner image to the sheet at the nip position;

a suspension roller that suspends the conveyance belt at a separation position, the separation position being downstream with respect to the nip position in a sheet conveyance direction, the separation position being positioned where the sheet separates from the conveyance belt, the voltage of reversed polarity to the charge polarity of the toner being applied to the suspension roller;

a conductive opposed member arranged opposed to the suspension roller across the conveyance belt;

a housing that internally houses the image carrier to carry the toner image;

an open/close cover that covers an opening so as to be openable/closable, the opening being formed on a side surface of the housing;

an image carrier protection member that moves to a protection position in association with an open operation of the open/close cover to cover the open/close cover side of the image carrier, the image carrier protection member moving to an open position in association with a close operation of the open/close cover to open the open/close cover side of the image carrier;

a suspension roller power supply unit that applies the voltage of the reversed polarity to the charge polarity of the toner to the suspension roller; and a protection member power supply unit that applies the voltage of the reversed polarity to the charge polarity of the toner to the image carrier protection member.

2. The image forming apparatus according to claim 1, further comprising:

a control unit that controls the suspension roller power supply unit and the protection member power supply unit, wherein the control unit matches a period during which a voltage is applied to the image carrier protection member by the protection member power supply unit and a period during which a voltage is applied to the suspension roller by the suspension roller power supply unit.

3. The image forming apparatus according to claim 2, wherein the image carrier protection member includes a conductive member.

* * * * *